United States Patent [19]

Thompson, III

[11] Patent Number: 4,618,745

[45] Date of Patent: Oct. 21, 1986

[54] CIRCUIT BREAKER MECHANISM

[75] Inventor: Harry A. Thompson, III, Lawrenceville, N.J.

[73] Assignee: Heinemann Electric Company, Lawrenceville, N.J.

[21] Appl. No.: 718,081

[22] Filed: Apr. 1, 1985

[51] Int. Cl.[4] ..... H01H 9/26; H01H 3/00

[52] U.S. Cl. ..... 200/50 C; 200/153 G; 335/186; 335/189; 335/191

[58] Field of Search ..... 200/50 C, 153 G, 153 H; 335/8–10, 24, 25, 28, 159, 160, 165, 166, 167, 171, 188, 189, 191, 186

[56] References Cited

U.S. PATENT DOCUMENTS

| | | | |
|---|---|---|---|
| 2,370,206 | 2/1945 | Taylor | 337/55 |
| 2,678,359 | 5/1954 | Brumfield | 335/8 |
| 2,690,486 | 9/1954 | Wilckens | 200/153 G X |
| 2,769,049 | 10/1956 | Edmunds | 200/153 G X |
| 2,811,607 | 10/1957 | Dorfman et al. | 337/48 |
| 2,824,191 | 2/1958 | Christensen | 337/50 |
| 2,889,428 | 6/1959 | Kingdon et al. | 337/43 |
| 3,098,911 | 7/1963 | Schwartz et al. | 335/9 |
| 3,353,127 | 11/1967 | Francis et al. | 335/9 |
| 3,593,235 | 7/1971 | Nicol | 335/186 |
| 3,646,487 | 2/1972 | Brackett, Sr. | 335/8 |
| 3,767,871 | 10/1973 | Strobel | 200/50 C |
| 3,774,129 | 11/1973 | Sugiyama | 335/167 |

*Primary Examiner*—J. R. Scott

*Attorney, Agent, or Firm*—Dann, Dorfman, Herrell and Skillman

[57] ABSTRACT

An actuating mechanism for a circuit breaker includes a pair of contacts supported relative to a frame. One of the contacts is supported on a contact arm which is displaceable about a pivot to open and close the contacts. A releasable latch holds a rotatable cradle arm in latched position against the bias of an over-center spring connected between the contact arm and the cradle arm to bias the contact arm into over-center positions. An actuating link is coupled with the contact arm. When the cradle arm is held in the latched position, movement of the link from a first position to a second position displaces the contact arm pivot over center, causing the over-center spring to move the contact arm to close the contacts. An electrically actuated trip mechanism releases the latch under predetermined conditions to permit displacement of the cradle arm under the bias of the over-center spring from the latched position to an unlatched position causing the over-center spring to move the contact arm to open the contacts. A cradle arm return spring displaces the cradle arm from the unlatched position back to the latched position and causes the link to rotate from the second position back to the first position as the over-center spring holds the contacts open.

39 Claims, 16 Drawing Figures

CIRCUIT BREAKER MECHANISM

FIELD OF THE INVENTION

The present invention relates to a circuit breaker mechanism and, more particularly, to an actuating mechanism for opening and closing the contacts of a circuit breaker.

BACKGROUND OF THE INVENTION

Conventional actuating mechanisms for circuit breakers typically include a collapsible toggle assembly which links an actuator, such as a manually movable switch, with a displaceable contact arm carrying one of the circuit breaker contacts so that manual movement of the switch causes the contacts to open or close. In a conventional arrangement, the toggle assembly includes two pivotally connected links and a releasable latch which is carried on the pivotable links for releasably latching the two pivotable links of the toggle assembly in a rigid uncollapsed position. One of the toggle assembly links is coupled to the manual actuator and the other link is coupled to the displaceable contact arm so that the movement of the manual actuator from one position to another causes the displacement of the rigidly held collapsible toggle assembly which, in turn, displaces the contact arm to open or close the contacts.

The conventional circuit breaker also includes an electro-magnetically actuated mechanical trip actuator to open the contacts of the circuit breaker under overload conditions. For this purpose, an electro-magnetic portion senses overload conditions and a mechanical portion engages and trips the normally rigid toggle assembly to collapse it and open the circuit breaker contacts. To trip the releasable latch which normally holds the toggle assembly rigid, the mechanical trip portion of the actuator includes a displaceable trip element. When an overload condition is sensed, the trip element is displaced by electro-magnetic forces into engagement with the latch causing the latch to release. When the latch is released, the toggle assembly collapses permitting the contacts of the circuit breaker mechanism to open.

One of the problems with conventional actuating mechanisms is that the latch is not held in a fixed position on the frame. Since the latch is typically carried on the pivotal links of the toggle assembly, the latch moves during the collapse of the toggle assembly. As a result, there can be a variation in the position where the trip element engages and releases the movable latch causing a margin of error to be introduced into the system. To compensate for possible variations in the engagement position, increased tolerances must be engineered into the design of the actuating mechanism to ensure that the circuit breakers, which are often mass produced, properly function within the proper specifications.

In accordance with the present invention, a unique actuating mechanism for a circuit breaker is provided which overcomes the inherent design problems associated with conventional actuating mechanisms.

SUMMARY OF THE INVENTION

In accordance with the present invention, a unique circuit breaker mechanism is provided. The mechanism includes a support frame and a pair of contacts supported relative to the frame. A contact arm carrying one of the contacts is supported relative to the frame. The contact frame has a pivot and is displaceable to open and close the contacts. The mechanism also includes a cradle arm mounted on the frame and displaceable relative to the frame between a latched and an unlatched position. Over-center biasing means such as an extension spring is connected between a connection on the contact arm and a connection of the cradle arm for biasing the contact arm into over-center positions relative to the pivot of the contact arm. A latch is supported relative to the frame for releasably latching the cradle arm in the latched position wherein the biasing means holds the cradle arm against the latch.

An actuating link is pivotally mounted on the frame and is coupled with the contact arm. When the cradle arm is held against the latch means in the latched position, movement of the actuator link from a first position to a second position displaces the pivot of the contact arm over center relative to the connections of the biasing means on the contact arm and the cradle arm causing the over-center biasing means to duplicate said contact arm to close the contacts.

Trip means is supported relative to the frame for releasing the latch under predetermined conditions. Release of the latch permits displacement of the cradle arm under the bias of the over-center biasing means from the latched position to an unlatched position. The displacement of the cradle arm to the unlatched position moves the connection of the biasing means on the cradle arm over center relative to the pivot of the contact arm which causes the biasing means to duplicate the contact arm to open the contacts.

Cradle arm return means, such as a return spring, is connected between the frame and the cradle arm for biasing the cradle arm to displace the cradle arm from the unlatched position back to the latched position. The return of the cradle arm to the latched position causes the actuator link to return from the second position back to the first position as the over-center biasing means continues to bias the contact arm to hold the contacts open.

BRIEF DESCRIPTION OF THE DRAWINGS

The foregoing summary, as well as the following detailed description of the preferred embodiment of the present invention, will be better understood when read in conjunction with the appended drawings, in which:

FIGS. 10*a* and 1O*b* are schematic views depicting the sequential operation of an electrical trip mechanism;

DETAILED DESCRIPTION OF THE PREFERRED EMBODIMENT

Figure 13:
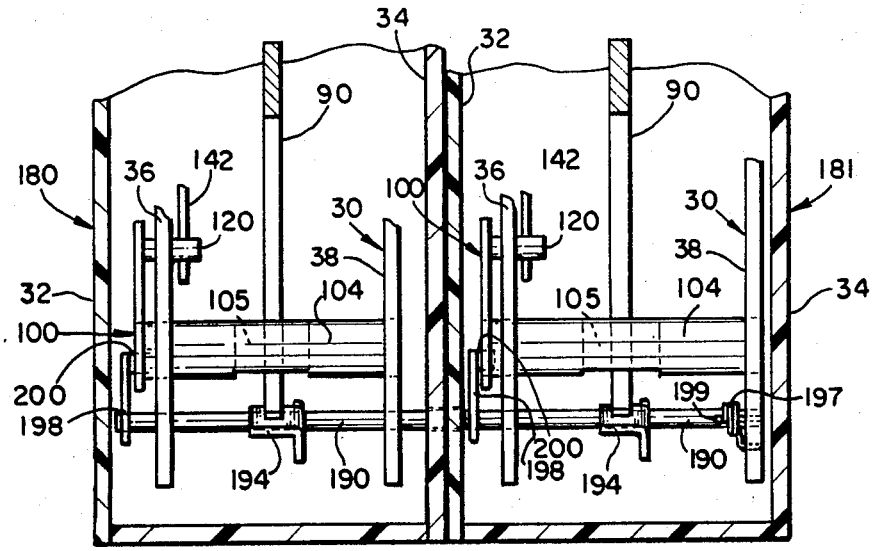
FIG. 13 is a fragmentary sectional view of a series of breakers depicting the interpole tripping mechanism.

Referring to the FIGS. 1–8, a circuit breaker, generally designated 10, is depicted. The circuit breaker includes an outer casing 12 molded of a resinous material which constitutes part of the support frame and houses an actuating mechanism, generally designated 15, for opening and closing internal contacts 20 and 22.

The outer casing 12 of the circuit breaker is formed by a generally hollow molded cover 24 which fits together in registry with a base 25 to form an enclosure for the internal operating mechanism. The casing 12 has generally parallel opposing sidewalls 32 and 34 and includes a main body enclosure portion 40 and an integral neck portion 42.

The circuit breaker also includes an internal support frame 30 which is housed within and fixed to the outer casing 12. The support frame 30 is a channel-shaped member which is formed from stamped and folded sheet metal to provide two generally parallel spaced support plates 36 and 38. The support frame 30 is the main support for the internal actuating mechanism and, as such, supports various components of the actuating mechanism and provides stop surfaces for some of the movable parts. The support frame 30 is fixed to the casing so that support plates 36 and 38 extend generally parallel with the opposing parallel side walls 32 and 34 of the outer casing 12. The support frame 30 also includes an integrally formed support tab 39 which projects from the support frame. The support tab 39 supports a component of an electromagnetic actuating device which will be described hereafter.

Figure 3:
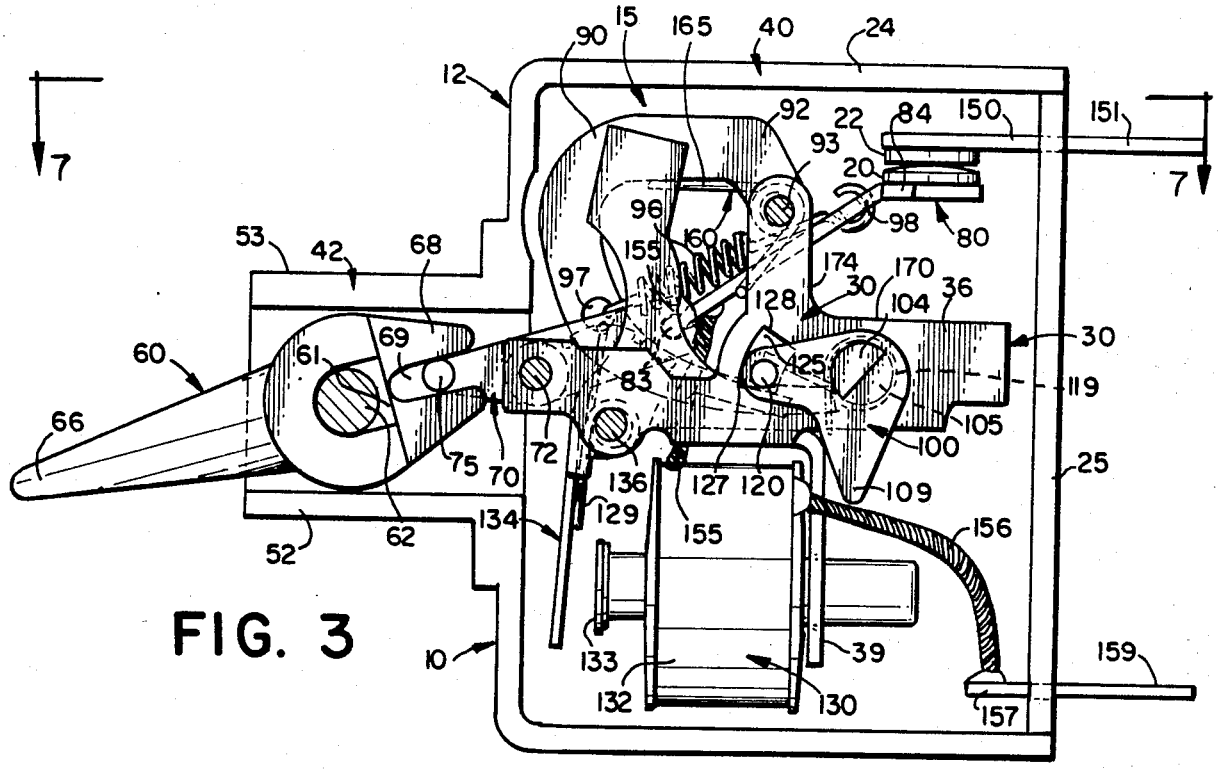
FIG. 3 is a side view of the circuit breaker mechanism with a portion of the casing cut away to depict the circuit breaker contacts in the closed position.
Figure 4:
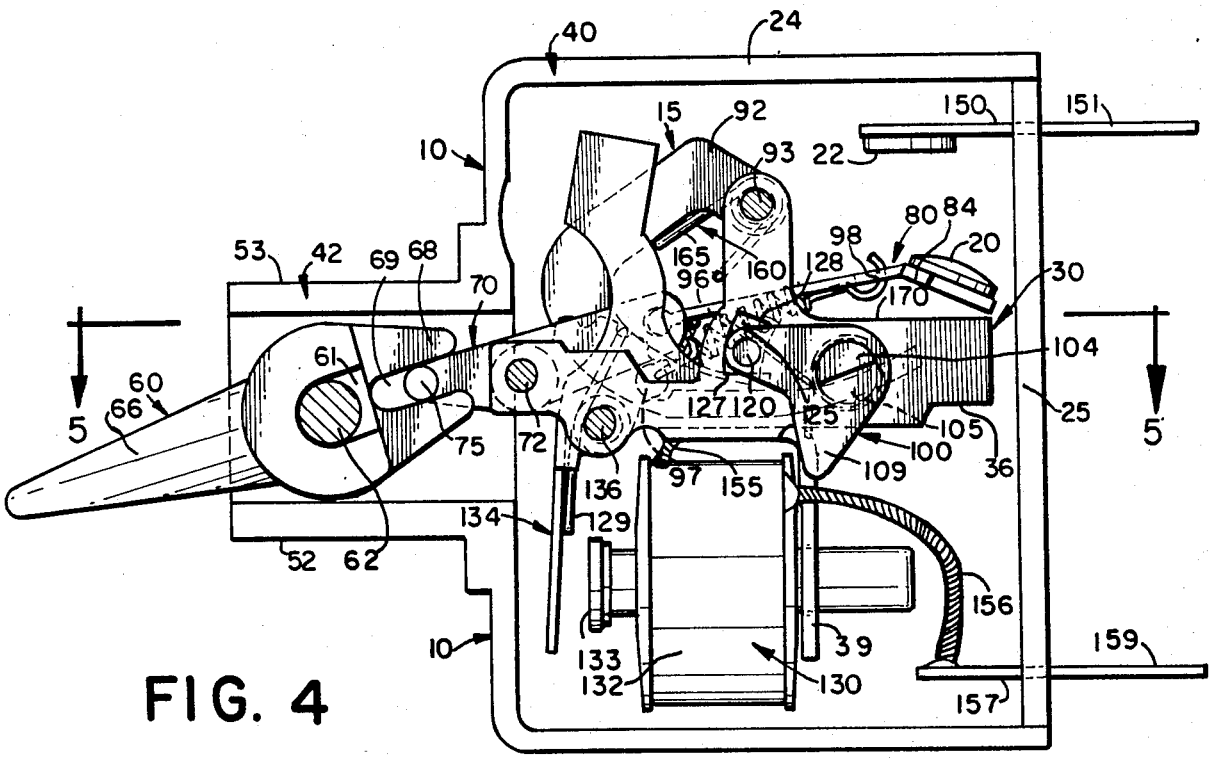
FIG. 4 is a side view of the circuit breaker mechanism illustrating a trip free position.
Figure 5:
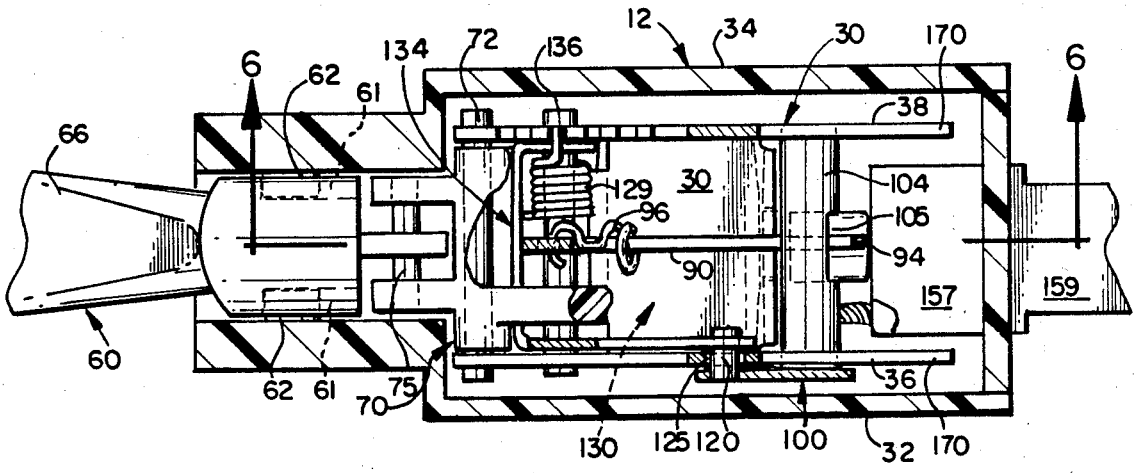
FIG. 5 is a sectional view of the apparatus as taken along line 5—5 of FIG. 4.
Figure 6:
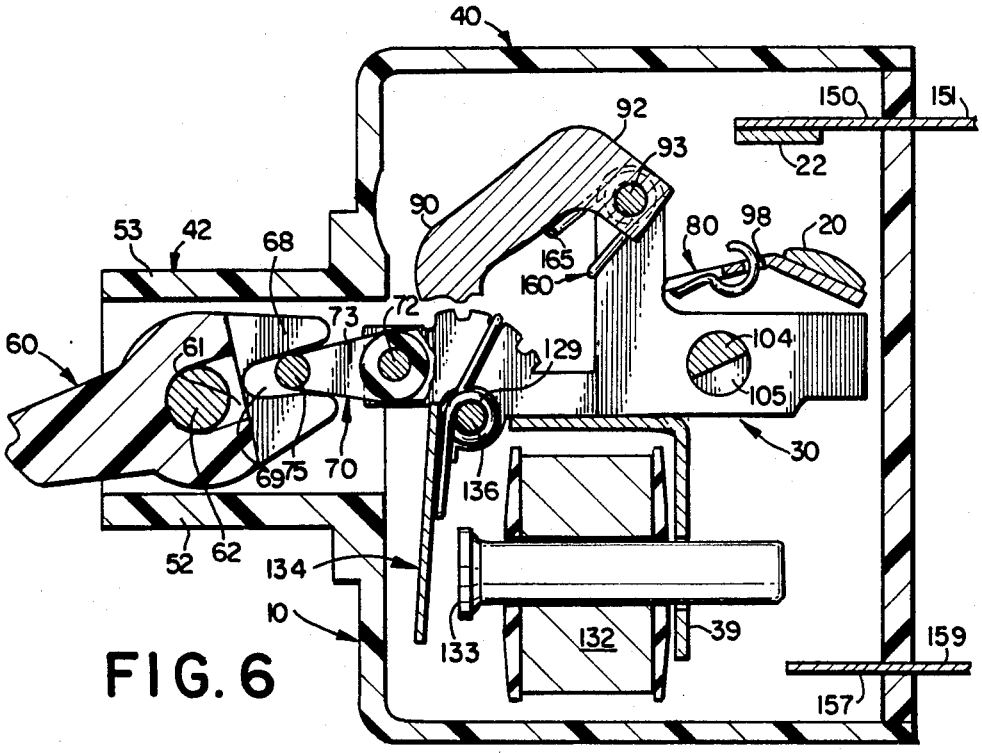
FIG. 6 is a sectional view taken along line 6—6 of FIG. 5.
Figure 7:
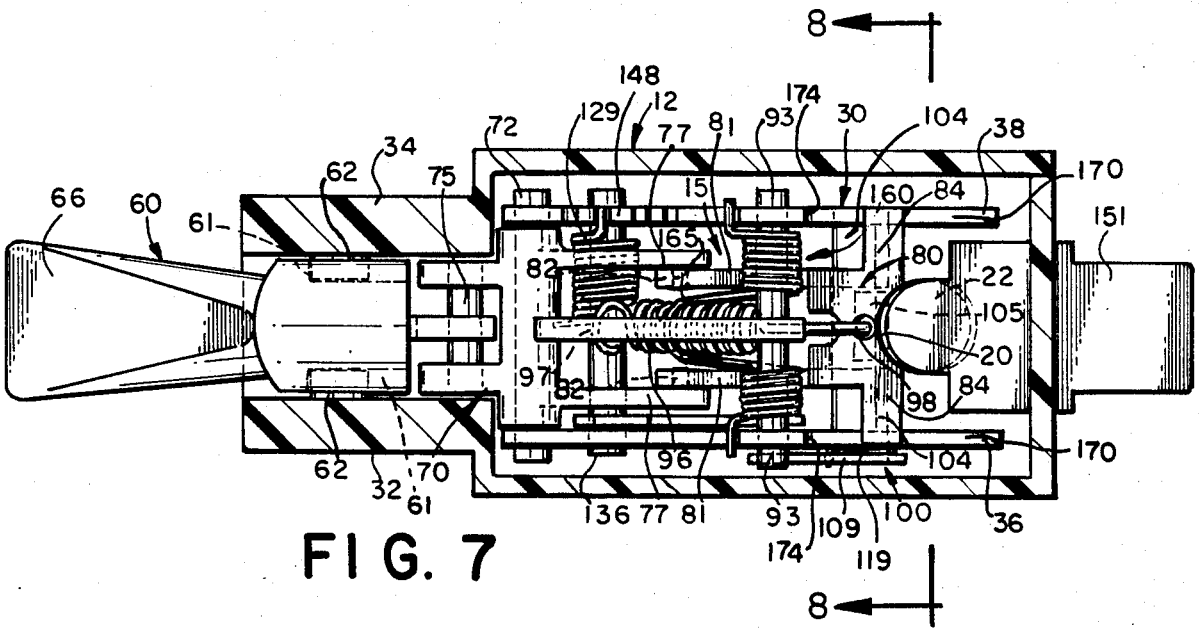
FIG. 7 is a sectional end view taken along line 7—7 of FIG. 3.
Figure 8:
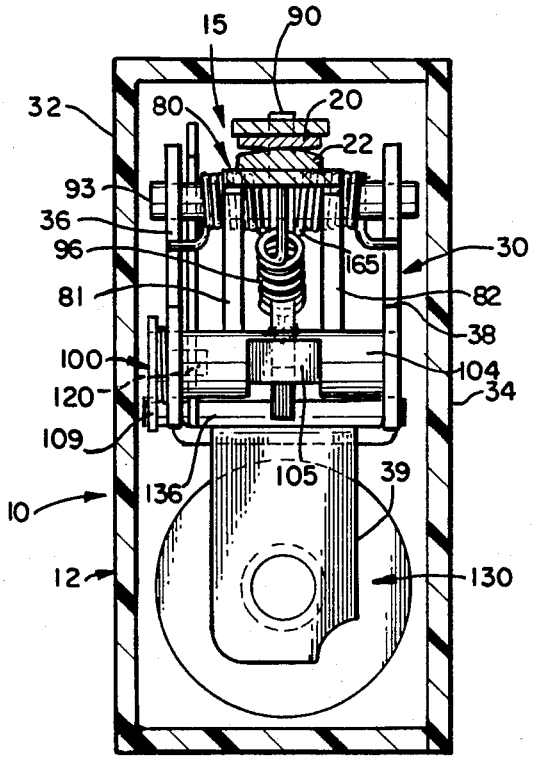
FIG. 8 is a sectional view taken along line 8—8 of FIG. 7.

As best depicted in FIGS. 5 and 7, a manual actuator in the form of switch lever 60 is pivotally mounted at the neck portion 42 of the casing. Socket cavities 61 are on opposite sides of the switch lever 60 permitting rotatable mounting of the switch lever on opposing spaced apart bosses 62 which project into the neck portion 42 of the casing 12 from the sidewalls 32 and 34. As illustrated in FIGS. 2–6, the socket cavities 61 are in the form of guide channels having enlarged portions which capture and rotatably hold bosses 62 when the switch lever 61 is inserted into the neck portion of the casing. The bosses 62 are aligned so that the rotational axis of the switch lever passes through the opposing bosses 62 generally perpendicular to the parallel sidewalls 32 and 34 of the casing. The rotational axis of the switch lever is fixed in position relative to the frame. One end 66 of the switch lever 60 projects outwardly from the neck portion 42 of the casing to provide an external switch handle. The other end 68 of the switch lever extends within the casing and has a slot 69 for rotatably embracing a pin 75 on an actuating link 70.

Figure 1:
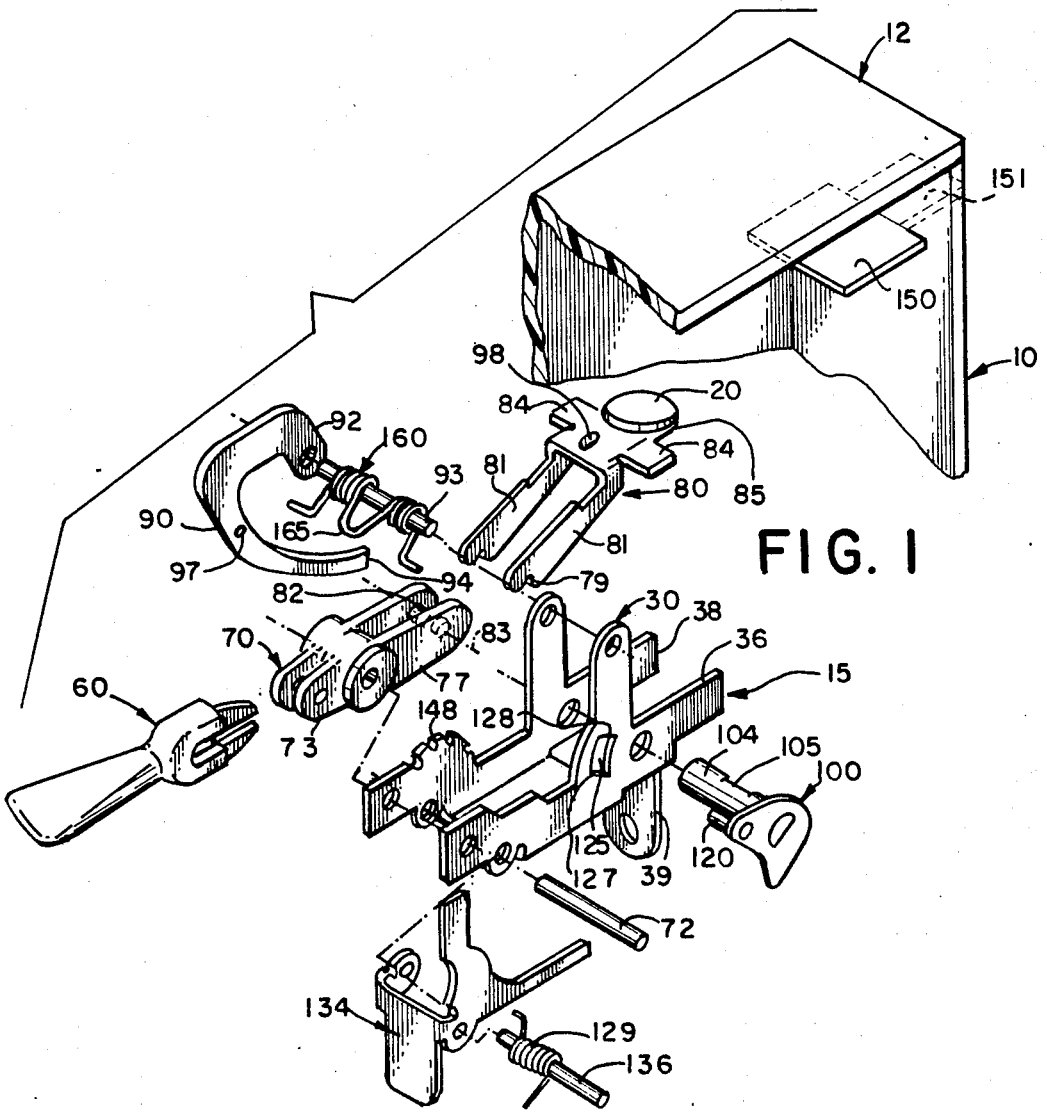
FIG. 1 is an exploded perspective view of the operating mechanism for a circuit breaker in accordance with a preferred embodiment of the present invention in which selected elements have been removed.
Figure 2:
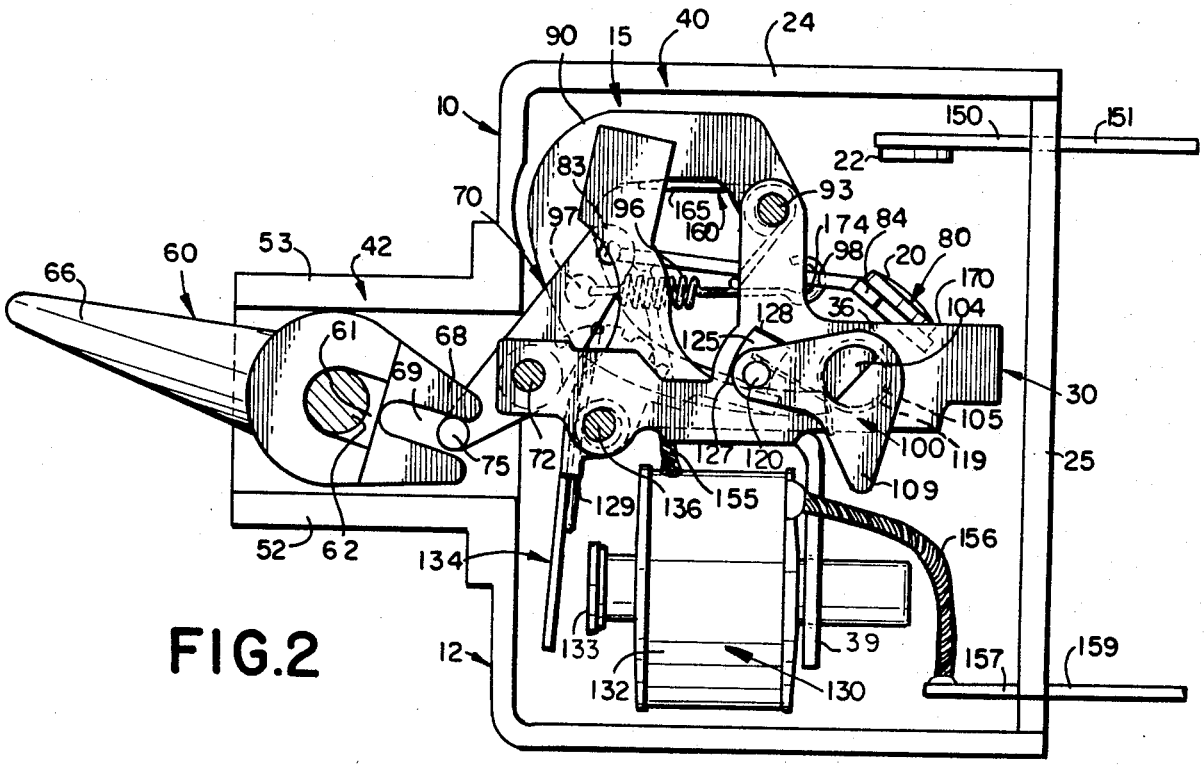
FIG. 2 is a side view of the circuit breaker mechanism with a portion of the casing cut away to depict the circuit breaker contacts in the open position.
Figure 9A:
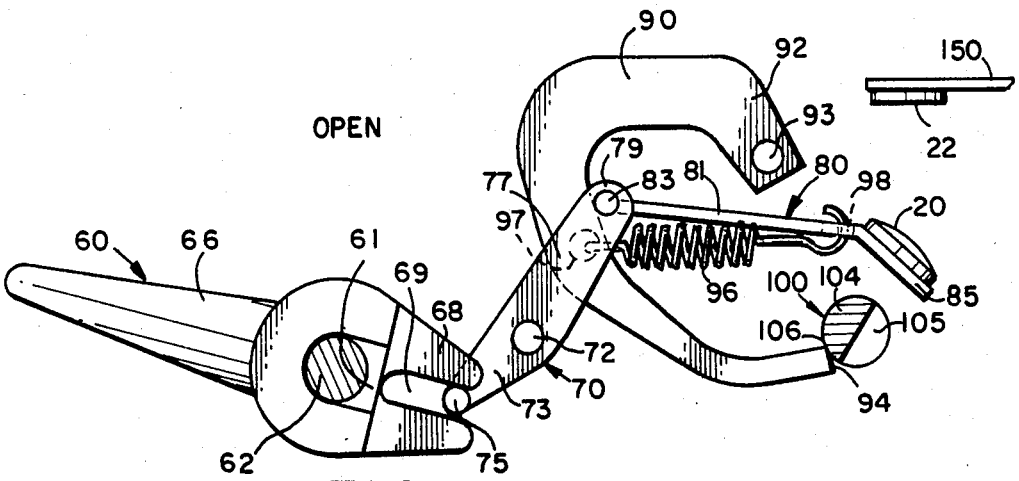
FIGS. 9*a*, 9*b* and 9*c* are schematic views illustrating some of the components of the operating mechanism in the open, closed and trip free positions respectively.
Figure 9B:
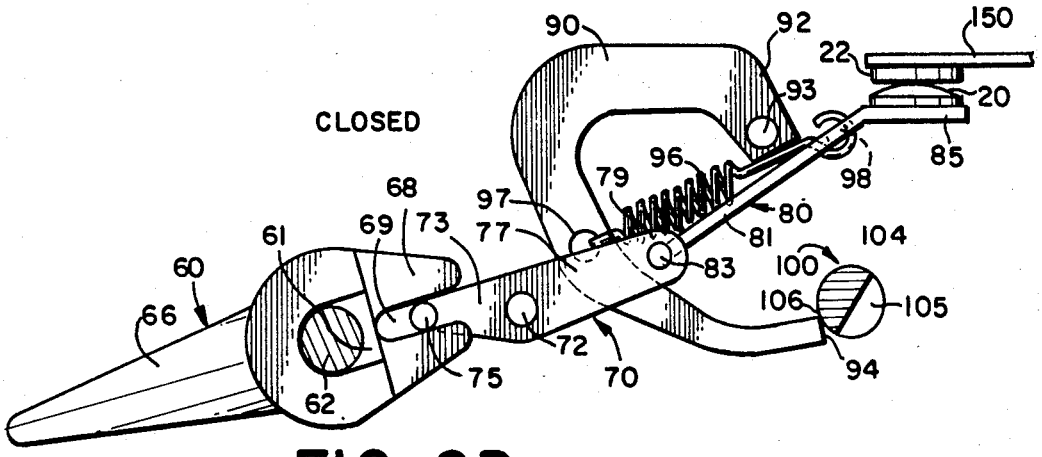

The actuating link 70 is formed of a molded generally rigid resinous material. As illustrated in FIG. 1, the link 70 is a generally symmetrical H-shaped member having a first pair of generally uniform spaced-apart parallel arms 73 at one end and a second pair of generally spaced apart parallel arms 77 at the other end. The link 70 is rotatably mounted relative to the frame by a shaft 72 which is rotatably carried and supported between the spaced plates 36 and 38 of the support frame 30. The rotational axis of the link 70 is oriented generally perpendicular to the parallel support plates 36 and 38 of the support frame and is fixed in position relative to the support frame 30. The parallel arms 73 and 77 extend in directions generally parallel to the parallel support plates 36 and 38. The first set of spaced apart arms 73 of the link are rotatably connected to the internal end 68 of the actuator lever 60 by pin 75. The pin 75 is supported between the arms 73 of the actuating link 70. The pin 75 is rotatably captured within the channeled slot 69 provided at the internal end 68 of the actuator lever 60. The switch lever 60 and the actuating link 70 are rotatably connected to each other in order to allow manual switching of the switch lever from a first position with contacts 20 and 22 open, as illustrated in FIGS. 2 and 9A, to a second position with contacts 20 and 22 closed, as illustrated in FIGS. 3 and 9B. The manual switching of the switch lever 60 causes the actuating link 70 to rotate between a first position, as illustrated in FIGS. 2 and 9A, and a second position, as illustrated in FIGS. 3 and 9B. Parallel end walls 52 and 53 of the neck portion 42 of the casing serve as stops to limit the movement of the switch lever 60. The actuating link 70 has stop surfaces which engage portions of the frame to limit rotational movement of the actuator link when the switch lever 60 is switched from the contacts open to the contacts closed position. When the switch lever 60 is switched from the contacts closed to the contacts open position, stop surfaces on the actuator link 70 may engage portions of the casing to limit rotational movement of the actuator link.

The switch lever 60 and the actuating link 70 have rotational axes which are fixed relative to the frame. In order to prevent binding, the slot 69 at the end of the switch lever permits both a translational and a rotational movement of the connecting pin 75 within the slot 69 when the switch lever is moved from one position to another to rotate the actuating link. At the other end of the pivotable link 70, the spaced apart arms 77 are each rotatably connected with a corresponding one of the spaced apart arms 81 of a displaceable contact arm 80.

The contact arm 80 is made of an electrically conductive material and is conductively connected with contact 20 carried at one end of the contact arm 80. The contact arm 80 includes generally uniform spaced apart parallel arms 81 which are each integrally connected at one end with an angled contact support 85. The contact arm 80 illustrated in FIG. 1 is of a slightly different shape from the contact arm 80 illustrated in the remaining Figs. Although the shape shown in FIG. 1 is preferred, the simpler flat form of the other Figs. is easier to see in the concentration of parts and is used for clarity. However, difference in shape does not affect the functional operation of the contact arm.

Integral guide bars 84 project outwardly from each side of the contact arm 80 proximate to contact 20 which is fixed to the contact support 85. As will be discussed hereafter, the guide bars 84 are displaced with the contact arm 80 into engagement with edges 170 and 174, illustrated in FIGS. 2, 5 and 7, of the support plates 36 and 38 which guide and limit the movement of the contact arm and contact 20. The spaced apart arms 81 of the contact arm are each rotatably connected with the spaced apart arms 77 of the actuating link 70 to provide the contact arm pivot and to permit relative rotational movement between the link 70 and the contact arm 80. As such, the contact arm and the link have cooperating portions which permit the relative rotational movement therebetween. For example, in the emobdiment illustrated in FIG. 1, a channelled slot 79 provided at the end of each spaced-apart arm 81 of the contact arm 80 captures a pin stub 82 provided on each corresponding arm 77 of the link 70. The pin stubs 82 are spaced apart and project from each arm 77 of the link 70. The pin stubs 82 rotate freely and also move linearly within the slots 79 permitting the link 70 and the contact arm 80 to rotate relative to one another about a rotational axis 83 passing through the pin stubs 82. The rotational axis is generally perpendicular to the parallel spaced plates 36 and 38 and the rotational axis moves relative to the support frame.

The rotatably connected arms 77 and 81 of the actuating link 70 and the contact arm 80, respectively, are spaced apart so that a passageway is provided between the respectively spaced apart arms. As can be appreciated from FIG. 1, a generally flat C-shaped cradle arm 90 having generally planar side walls passes through the passageway. The cradle arm 90, which may be constructed of metal, has one end 92 rotatably mounted to the frame by a pin 93 which is carried and supported by spaced support plates 36 and 38 of the frame. The cradle arm 90 extends from pin 93 between the spaced apart arms 77 and 81 of the link 70 and the contact arm 80 and terminates in an abutment end 94. The cradle arm 90 rotates about pin 93 in the general parallel planes in which it lies parallel to the support plates. Pin 93 provides a rotational axis for the cradle arm which is generally perpendicular to the parallel support plates 36 and 38 of the frame and which is fixed in position relative to the frame. The cradle arm 90 is rotably supported on pin 93 so that the cradle arm moves along a rotational path passing between the spaced apart arms 77 and 81 of the link 70 and the contact arm 80.

The main spring 96 of the circuit breaker is in the form of an extension spring. One end of the main spring 96 is connected to the cradle arm 90 at an aperture 97 located approximately midway between the opposite ends 92 and 94 of the cradle arm 90. The other end of the main spring 96 is connected with the contact arm 80 at aperture 98 located proximate to the contact 20 at the one end of the contact arm. The main spring 96 provides over center bias for the contact arm 80. The points of connection 97 and 98 define the over center line through which the pivot or rotational axis 83 of the contact arm 80 passes. Sufficient clearance is provided between the spaced apart arms 77 and 81 of the link 70 and the contact arm 80 to permit the cradle arm 90 and the main spring 96 to pass therebetween.

A latch 100 rotatably supported on the frame 30 retains the cradle arm in a latched position under the bias of main spring 96. The latch 100 includes a generally cylindrical rotatable shaft 104 having end portions carried and supported by spaced plates 36 and 38 of the support frame. An intermediate portion of the rotatable shaft 104 disposed between end plates 36 and 38 includes a passageway 105 in the form of diametric slot cut transversely across the intermediate portion of the shaft 104. A stop surface 106 for the abutment end 94 of the cradle arm 90 is provided along the periphery of the shaft 104 proximate passageway 105. In a latched position, main spring 96 holds the abutment end 94 of the cradle arm in engagement with the stop surface 106 of the shaft 104 to releasably retain the cradle arm in a stable latched position.

One end of the rotatable shaft 104 extends through support plate 36 and carries a crank member 109 which is fixedly mounted on the protruding end of the shaft. The crank member 109 carries a trip pin 120 oriented generally parallel to shaft 104. The trip pin 120 protrudes from the crank member 109 back into the channel formed between the spaced plates 36 and 38 through an opening 125 provided in the support plate 36. Rotational movement of the latch 100 and the shaft 104 is limited by the engagement of the trip pin 120 with edges 127 and 128 at opposite ends of the opening 125 in the support plate 36.

A latch spring 119 in the form of a torsion spring is carried on the rotatable shaft 104 of latch 100. The torsion spring is positioned at the end of the rotatable shaft intermediate crank member 109 and support plate 36. One end of the torsion spring is connected with trip pin 120 and the other end is connected to the spaced plate 36. The latch spring 119 biases the latch so that the trip pin 120 mounted on crank member 109 engages and rests against edge 127 of the opening 125. As illustrated in FIGS. 2 and 3, the latch is biased in the counterclockwise direction about shaft 104. When biased against edge 127, the rotatable shaft 104 is held in position so that the abutment end 94 of the cradle arm 90 engages the stop surface 106 on the outer periphery of the rotatable shaft 104 so that the cradle arm 90 is held in a stable latched position under the bias of the main spring 96.

A cradle arm return spring 160 in the form of a double torsion spring is carried on pin 93 about which the cradle arm 90 rotates. The opposite legs of the spring are connected to the respective support plates 36 and 38. The center portion 165 of the spring engages the inner edge of the C-shaped cradle arm and biases the cradle arm in the direction tending to cause the abutment end 94 of the cradle arm 90 to pivot away from the stop surface 106 on the rotatable shaft 104 of the latch 100. As illustrated in FIGS. 2, 3, 4 and 6, the return spring 160 biases the cradle arm 90 in the clockwise direction about pin 93. The cradle arm return spring 160 biases the cradle arm with sufficient force to reduce the contact pressure between the abutment end 94 of the cradle arm 90 and the stop surface 106 of the latch when the cradle arm is held by main spring 96 in the latched position against stop surface 106. As will be described hereafter, when the cradle arm 90 is displaced into an unlatched position, the cradle arm return spring 160 biases the cradle arm causing it to rotate back to the latched position.

An electromagnetic actuating device, generally designated 130, is provided to trip the latch 100 under predetermined conditions, such as a current or voltage overload. The electromagnetic actuating device includes an electromagnetic coil 132 which is supported on and fixed to the support tab 39 of the internal support frame 30. The electromagnetic coil 132 includes pole piece 133 which, under overload conditions, attracts a rotatable armature 134 to trip the latch 100 under the predetermined overload conditions. For this purpose, the electromagnetic coil includes a time delay tube which houses a viscous fluid and a spring biased magnetic core. The magnetic core is movable against the spring bias and the retarding action of the viscous fluid to provide a calibrated time delay before the circuit breaker is tripped upon overload conditions.

Figure 10A:
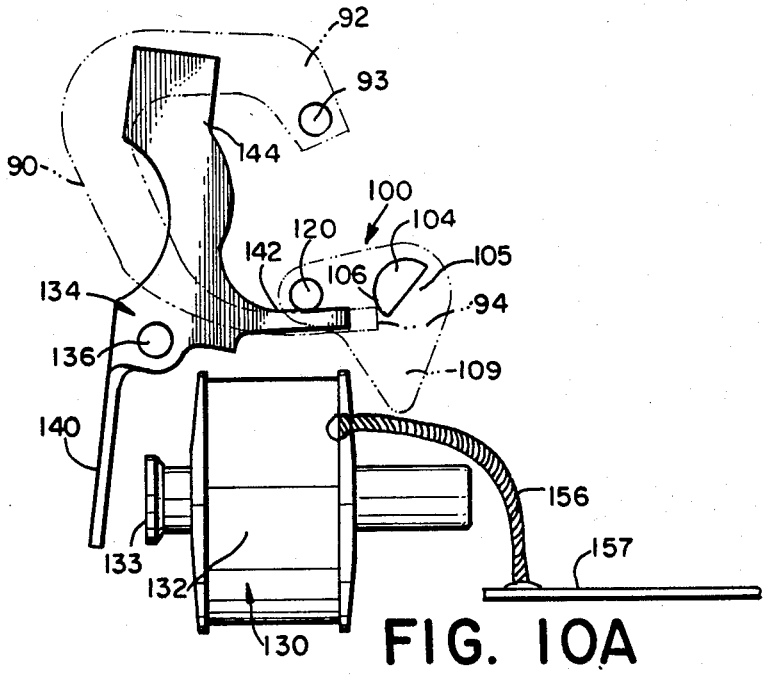
Figure 10B:
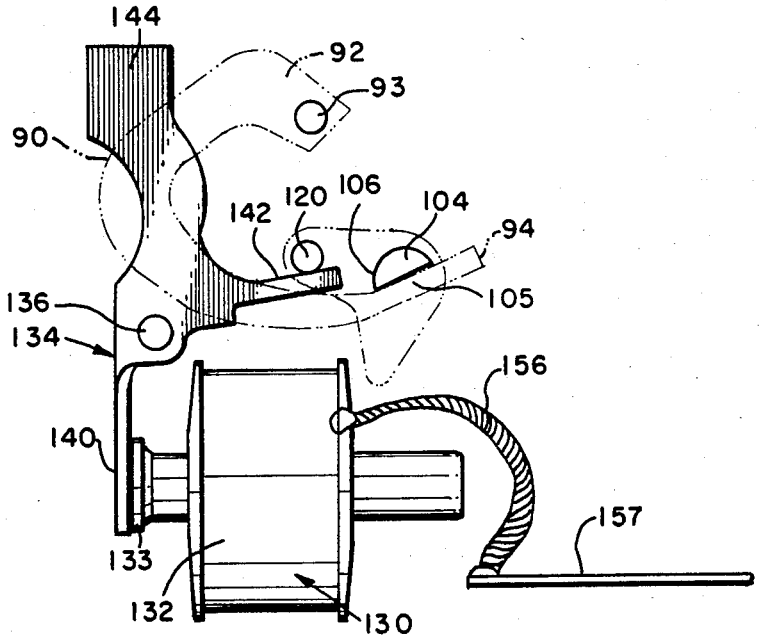

The armature 134 is rotatably mounted to the frame by pin 136 extending between the spaced plates 36 and 38 of the support frame. The rotational axis of the armature element 134 is generally perpendicular to the parallel plates 36 and 38 and is fixed in position relative to the frame. The armature 134 is constructed of a magnetic and conductive material and includes an integrally movable clapper 140, tail piece 142 and counterweight 144. The armature 134 is rotatably mounted so that the clapper is positioned proximate to the pole piece 133 of the electromagnetic coil 132. Under overload conditions, the clapper 140 of the armature is attracted by the pole piece 133 causing the armature 134 to rotate until the clapper 140 engages the pole piece 133 as illustrated in FIG. 10B.

An armature spring 129 in the form of a torsion spring is carried on pin 136 and has one leg engaging the clapper 140 and the other leg connected with a a notch on a notch setting 148 provided by the support frame plate 38. Selection of a particular notch for connection of the appropriate end of the spring permits adjustment of the tension force applied by the armature spring 129. The spring 129 is connected to bias the clapper 140 out of engagement with pole piece 133 so that the attraction and rotational movement of the clapper 140 toward pole piece 133 under predetermined overload conditions is against the bias of the armature spring 129. As illustrated in FIGS. 2, 3 and 6, the armature spring 129 biases the armature 134 in a clockwise direction about pin 136.

The tail piece 142 of the armature is integral with the clapper 140 and is positioned so that whenever the clapper 140 is attracted to pole piece 133 under overload conditions the tail piece rotates to engage the trip pin 120 of the latch 100, causing the latch to rotate against the bias of the latch spring 119. When the latch rotates, the trip pin which is normally biased against edge 127 of the opening 125 in support plate 36 rotates toward the opposite edge 128 of the opening 125. The rotational movement of the latch 100 imparted by the armature 134 against the bias of the latch spring 129 is limited by the engagement of the trip pin 120 with the edge 128 of the opening 125 in support plate 36. As illustrated in FIG. 4, the armature 134 has already returned to its normal position out of engagement with pole piece 133 but the latch 100 is rotated so that the pin 120 has not yet returned to rest against edge 127. The counterweight 144 of the armature element 134 is positioned relative to the rotational axis of the armature 134 to counterbalance the weight of the clapper 140 and the tail piece 142.

Considering the electrical circuit components, contact 22 is held in a relatively fixed position relative to the frame by a resilient electrically conductive contact support 150 which extends through the housing to provide an external terminal 151. Contact 20 is conductively connected to the contact arm 80 which is made of an electrically conductive material. As illustrated in FIGS. 2 and 3, the contact arm 80 is connected by a flexible pig tail conductor 155 to one end of the electromagnetic coil 132. The other end of the electromagnetic coil 132 is connected by a flexible pig tail conductor 156 to electrically conductive terminal element 157 which extends through the housing to provide an external terminal 159.

With respect to the operation of the circuit breaker, the contacts 20 and 22 of the circuit breaker may be manually switched between the contacts open position, as illustrated in FIGS. 2 and 9A, and the contacts closed position, as illustrated in FIGS. 3 and 9B. The contacts 20 and 22 may be switched from the open position as illustrated in FIGS. 2 and 9A by manually switching the switch lever 60 from the first position illustrated in FIGS. 2 and 9A to the second position illustrated in FIGS. 3 and 9B. When the contacts are in the open position, as illustrated in FIGS. 2 and 9A, the manual switch lever 60 and the link 70 are disposed in their respective first positions. The cradle arm 90 is held in the latched position under the bias of the main spring 96 with abutment end 94 of the cradle arm 90 in engagement with the stop surface 106 on the rotatable shaft 104 of the latch 100. The main spring 96 is tensioned to bias connection 97 on the cradle arm and the connection 98 on the contact arm toward one another. During switching, the contact arm 80 is rotated relative to the actuating link about the rotational axis 83 of the contact arm passing through pin stubs 82. The contact arm 80 is disposed so that its rotational axis 83 is in an over-center position relative to the connections 97 and 98 of the main spring 96 so that the main spring 96 biases the contact arm 80 to hold the contacts open, as illustrated in FIGS. 2 and 9A. In the open position, the contact arm 80 is biased so that the guide bars 84 of the contact arm 80 are held by the main spring against edges 174 of support plates 36 and 38 which limit the movement of the contact arm to the contacts open position. In FIG. 2, the contact arm 80 has not yet come to rest against edges 174 of the frame.

When the contacts 20 and 22 are switched to the contacts closed position, as illustrated in FIGS. 3 and 9B, the manual switch lever is rotated about an axis passing through bosses 62 from its first position, as illustrated in FIGS. 2 and 9A, to the second position, as illustrated in FIGS. 3 and 9B. Rotation of the manual switch lever from its first to its second position causes the link 70 to rotate about pin 72 from its first position with the contacts held open to its second position, as illustrated in FIGS. 3 and 9B, in which the contacts are held closed. The rotational movement of link 70 about pin 72 causes the rotatably connected contact arm 80 to displace. As the contact arm 80 moves, the guide bars 84 on the contact arm contact and slide along edges 170 of the support plates 36 and 38 until the rotational axis 83 of the contact arm moves over center relative to the connections 97 and 98 of the main spring. When the pivot of contact arm moves over center, the main spring 96 exerts a force on the contact arm 80 causing it to rotate about its rotational axis 83 away from the guide plates 36 and 38 and into the contacts closed position as illustrated in FIGS. 3 and 9B. The main spring 96 biases the contact arm 80 in the over-center position illustrated in FIGS. 3 and 9B, so that contacts 20 and 22 are held in conductive engagement with one another.

The circuit breaker may also be manually switched from the contacts closed position back to the contacts open position. The manual movement of the switch lever from its second position, as illustrated in FIGS. 3 and 9B, back to its first position, as illustrated in FIGS. 2 and 9A, causes the link 70 to rotate about pin 72 from its second position back to its first position. The rotational movement of the link 70 back to its first position causes the rotational axis 83 of the contact arm to move over center relative to the connection points 97 and 98 of the main spring 96. The contact arm pivot moves over center by passing the spring 96 and crossing the imaginary line between spring connection points 97 and 98. Once over center, the main spring 96 exerts a force on the contact arm 80 which causes the contact arm 80 to rotate about axis 83 into the contacts open position, as illustrated in FIGS. 2 and 9A.

To minimize arcing between the opening contacts, the breaker has a snap action. When the contact arm pivot passes over center relative to the connection points 97 and 98 of the main spring 96, the main spring 96 rapidly exerts a force on the contact arm 80 which causes the contact arm to snap open. The contact arm 80 moves quickly away from stationary contact 22 so that contact 20 carried on the contact arm 80 is moved out of conductive engagement with contact 22. The edges 170 of support plates 36 and 38 stop the rotational movement of the contact arm. The guide bars 84 of the contact arm then slide along edges 170 of support plates 36 and 38 into a retracted position where the guide bars 84 engage and rest against stop edges 174 on the guide plates 36 and 38. The stop edges 174 limit movement of the contact arm 80 at the contacts open position. By stopping the movement of the contact arm 80, the rotational movement of the actuating link 70 is thereby stopped. In FIG. 2, guide bars 84 have not yet come to rest against stop edges 174.

Figure 9C:
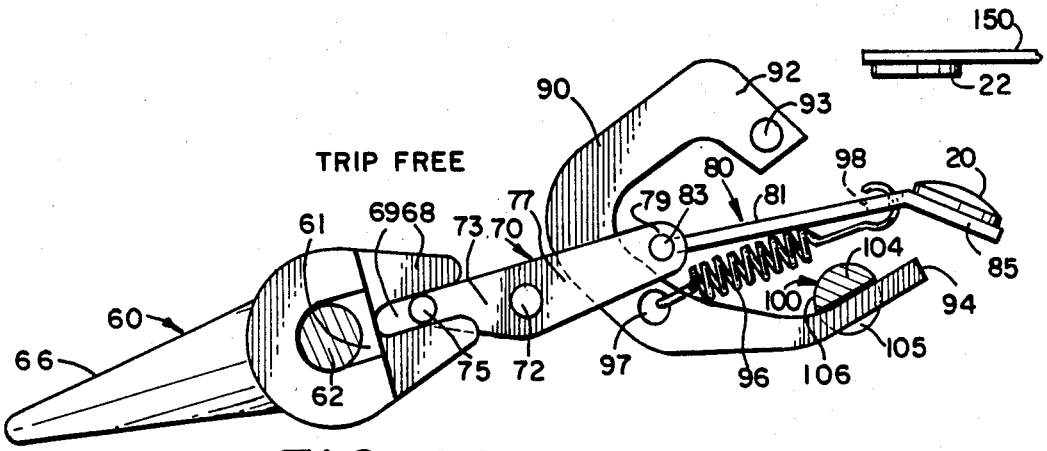

During operation, the contacts 20 and 22 of the circuit breaker may also be automatically tripped open by the electromagnetic actuating device 130 under predetermined overload conditions. The sequential movement of the armature 134 in tripping open the breaker contacts is illustrated in FIGS. 10A and 10B. As illustrated in FIG. 10B, when an overload exists, the clapper 140 of the armature 134 is attracted to the pole piece 133 of the electromagnetic coil 132 from the normal resting position illustrated in FIG. 10A. The movement of the clapper 140 toward the pole piece 133 causes the armature 134 to rotate about pin 136. As the armature 134 rotates, the tail piece 142 engages the trip pin 120 of the latch 100 causing the latch shaft 104 to rotate against the bias of the latch spring 119. Rotational movement of the latch 100 rotatably moves the stop surface 106 on the latch shaft 104 out of engagement with the abutment end 94 of the cradle arm 90. As the stop surface 106 on the outer periphery of the latch shaft 104 disengages from the abutment end of the cradle arm 90, the passageway 105 on the latch shaft 104 is moved into alignment with the abutment end 94 of the cradle arm 100. Because the cradle arm 90 is aligned with the passageway 105, as soon as the stop surface 106 is completely removed, the cradle arm 90 rotates about its supporting pin 93 through the slotted passageway 105 under the bias of main spring 96. As the cradle arm 90 rotates, the abutment end 94 of the cradle arm passes through and beyond the passageway 105 on the latch shaft, as illustrated in FIGS. 9C and 10B. As the cradle arm rotatably moves from its latched position, connection point 97 of the main spring 96 on the cradle arm 90 moves relative to the rotational axis 83 of the contact arm 80 until the main spring 96 passes by the rotational axis 83 of the contact arm. As connection 97 of the main spring 96 moves the main spring 96 over center relative to the rotational axis 83 of the contact arm 80, the main spring urges the contact arm 80 to rotate into a contact open position as illustrated in FIGS. 4 and 9C.

As the contact arm is rotated into a fully retracted open position, the guide bars 84 on the contact arm 80 move into engagement with edges 170 of guide plates 36 and 38 which stop the rotational movement of the contact arm 80. By the time the contact arm 80 engages edges 170 of the guide plates, the main spring 96 begins to collapse. Therefore, the tension of the cradle arm return spring 160 exceeds the tension supplied by main spring 96. Upon collapse of the main spring 96, the cradle arm return spring 160 overpowers the main spring to bias the cradle arm 90 back in the direction from which it came. This reverse bias causes the cradle arm to rotate from its unlatched position back to its latched position. By the time the abutment end 94 of the cradle arm passes back through the slotted passageway 105 the contacts have opened, the tail piece 142 has rotated out of engagement with the trip pin 120, and the latch is free to return to its original latching position under the urging of latch spring 119. The latch spring 119 biases the latch so that the latch shaft 104 rotates back into the latching position. As the cradle arm passes back through the slotted passageway, the stop surface 106 of the latch shaft 104 is positioned to engage the end 94 of the cradle arm. The rotational movement of the cradle arm back toward the latched position increases the tension on main spring 96 so that by the time the cradle arm passes back out of passageway 105, the tension of the main spring 96 is again greater than that of the return spring 160 and effective to hold the abutment end 94 of the cradle arm 90 in engagement with the stop surface 106 of the latch 100. In this manner, the cradle arm is automatically relatched.

As the cradle arm 90 rotates back toward its latched position under the bias of the cradle arm return spring 160, the increased tension on main spring 96 causes the actuating link 70 and the switch lever 60 to rotate back toward their respective first positions, as illustrated in FIGS. 2 and 9A. As the link 70 and the switch lever 60 return to their respective first positions, the main spring 96 continues to bias the contact arm 80 to hold the contacts open. As the link 70 rotates back to its first position, the contact arm 80 slides along the edges 170 of the support plates 36 and 38 until the guide bars 84 of the contact arm 80 engage and rest against the stop edges 174 on the support plates 36 and 38. In FIG. 2, the contact arm 80 has not yet come to rest against edge 174. The stop edges 174 limit the sliding motion of the contact arm 80 along edges 170 of the support plate and stop the movement of the contact arm 80 in a fully retracted contacts open position.

When the contacts 20 and 22 are initially tripped open under the overload conditions, the interruption of current through the actuating coil 132 causes the armature 134 to rotate away from pole piece 133 under the bias of the armature spring 129 as illustrated in FIG. 10A. The movement of the armature causes the tail piece 142 of the armature to rotate out of engagement with trip pin 120 on latch 100. When the tail piece disengages from the trip pin 120, the bias of the latch spring 119 urges the latch back toward its latching position.

As illustrated in FIGS. 4 and 9C, the actuating mechanism is trip free so that, even if the switch lever 60 is manually held in its second position, the armature 134 will still trip the latch 100 to snap open the contacts 20 and 22. When the latch is tripped with the switch lever held in the second position, the contact arm is rotated about rotational axis 83 into a contact open position with the guide bars 84 of the contact arm 80 resting against edges 170 of the support plates 36 and 38. In FIG. 4, the contact arm 80 is rotating toward edges 170 of the guide plate but has not yet come to rest against the edges 170. As long as the switch lever is manually held in the second position, the actuating link will remain in its second position and the cradle arm will remain in its unlatched position as illustrated in FIGS. 4 and 9C. As shown in FIG. 4, the armature 134 is free to rotate back to its normal position out of engagement with pole piece 133 as soon as the circuit is interrupted by the contacts opening. Once the manual switch lever 60 is released, the cradle arm return spring 160 will bias the cradle arm 90 into its latched position and the actuating link 70 and the switch lever 60 will rotate back into their respective first positions under the tension of the main spring 96. As the link rotates back to its first position, the contact arm will slide along edges 170 of the support plates 36 and 38 into the fully retracted open position resting against stop edges 174 of the support plates 36 and 38.

Figure 11:
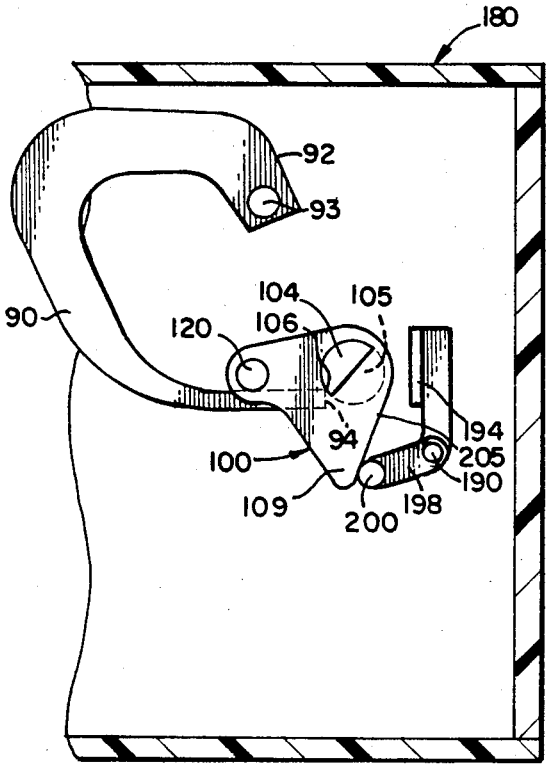
FIGS. 11 and 12 are fragmentary schematic views of an interpole tripping mechanism.
Figure 12:
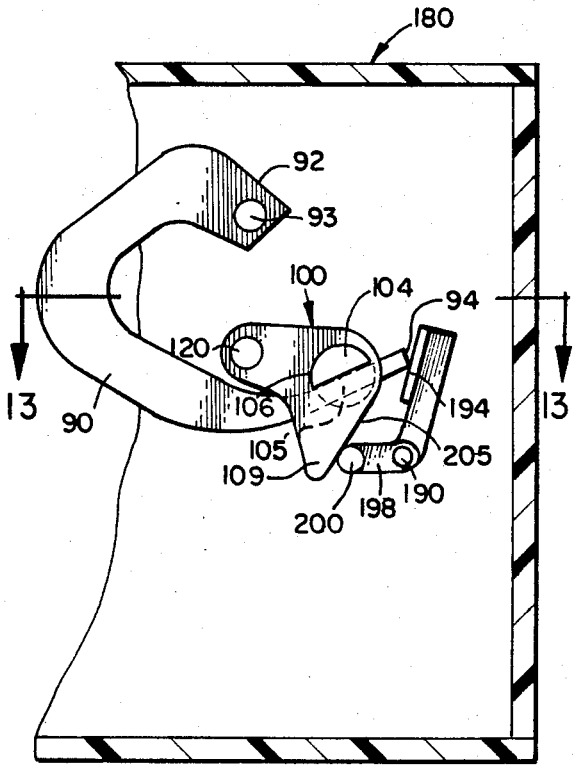

With reference to FIGS. 11, 12 and 13, to permit inter-pole tripping of ganged circuit breakers 180 and 181, a rotatable shaft 190 common to all breakers extends through and is supported by the parallel side walls 32 and 34 or a common barrier of the adjoining circuit breakers 180 and 181. Additional breakers may be added in similar side-by-side relationship, if desired. The common shaft 190 extends through the same position in each one of the series of ganged breakers and in each breaker a crank arm 194 projects radially outward from the rotatable shaft 190 in a common plane. Each crank arm 194 is positioned proximate to the latch shaft 104 at the exit end of the slotted passageway 105. Each of crank arms 194 is aligned in a triggering position so that upon the tripping of the respective circuit breaker, the abutment end 94 of the cradle arm will pass through the slotted passageway 105 and engage its corresponding crank arm 194 causing the rotatable shaft 190 to rotate. As illustrated in FIG. 12, the shaft 190 would rotate in a clockwise direction.

The shaft 190 rotates against the bias of a return spring 197. The return spring 197 is a torsion spring which is carried on shaft 190 with one leg passing through a diametric slot 199 in the shaft 190 and the other leg biased against plate 38 of the support frame. Inter-pole tripping is effected by a separate actuator arm 198 for each one of the breakers. Each arm 198 projects radially outward from rotatable shaft 190 in a common plane, each proximate to latch 100. Each actuator arm 198 includes a transversely mounted pin or surface 200, generally parallel to shaft 190. The pin 200 moves into engagement with a cooperating cam surface 205 on the crank member 109 of the latch 100.

When one of the circuit breakers is tripped, the cradle arm 90 of the tripped breaker moves to its unlatched position so that the abutment end 94 of the cradle arm 90 engages the corresponding crank arm 194 causing the rotatable shaft 190 to rotate. As the shaft 190 rotates, the actuator arms 198 mounted on the rotatable shaft 190 also rotate. As the corresponding actuator arm 198 in an untripped circuit breaker rotates, the actuating pin or surface 200 engages the cam surface 205 on the crank member 109 of the latch 100, causing the latch 100 to rotate. As the latch 100 rotates, its slotted passageway 105 becomes aligned to permit the rotational movement of the cradle arm 90 from its latched position to its unlatched position. The rotational movement of the cradle arm to its unlatched position causes the imaginary line between the connection points 97 and 98 of the main spring to pass by the rotational axis 83 of the contact arm 80 so that the main spring 96 biases the contact arm to trip open the contacts 20 and 22 in the manner previously discussed. After the breakers are tripped open, and the actuating cradle arm 90 begins to return to latched position, the return spring 197 rotates the shaft 190 so that the respective crank arms 194 in each breaker are positioned to engage the abutment end 94 of a corresponding cradle arm 90 at the exit end of the cradle arm passageway 105 in the latch shaft 104. In this arrangement, if an overload occurs in one circuit breaker, other parallel breakers will be tripped open by the rotational movement of the rotatable shaft 190 and the corresponding actuator arm 198.

From the foregoing description and the accompanying drawings, it can seen that the present invention provides a circuit breaker mechanism which is compact and very effective in operation. It will be recognized by those skilled in the art that changes or modifications may be made to the above-described embodiment departing from the broad inventive concepts of the invention. For example, instead of a rotatable cradle arm, a slidable device might be used. It is understood, therefore, that this invention is not limited to the particular embodiment described, but is intended to cover all changes and modifications which are within the scope and spirit of the invention as set forth in the appended claims.

I claim:

1. A circuit breaker mechanism comprising:

(A) a frame;

(B) a pair of contacts supported relative to the frame displaceable relative to one another between open and closed positions;

(C) a contact arm supported relative to the frame carrying one of the contacts, said contact arm having a pivot and being displaceable to open and close the contacts;

(D) a cradle arm supported relative to the frame displaceable between a latched position and an unlatched position;

(E) over-center biasing means connected between a connection on the contact arm and a connection on the cradle arm for biasing said contact arm into over-center positions about the contact arm pivot;

(F) latch means supported relative to the frame for releasably latching said cradle arm in the latched position wherein the biasing means holds the cradle arm against the latch means;

(G) an actuator link rotatably mounted on the frame and coupled with the contact arm at the contact arm pivot so that when the cradle arm is held against the latch means in the latched position movement of said actuator link from a first position to a second position displaces the pivot of the contact arm over center relative to the connections on the cradle arm and the contact arm causing the over-center biasing means to displace said contact arm to close the contacts;

(H) trip means supported relative to the frame for releasing the latch means under predetermined conditions to permit displacement of the cradle arm by the biasing means from the latched position to the unlatched position moving the connection on the cradle arm relative to the pivot of the contact arm so that the pivot of the contact arm is passed over center relative to the connections on the cradle arm and the contact arm causing the biasing means to displace said contact arm to open the contacts; and (I) cradle arm return means connected between the frame and the cradle arm to displace the cradle arm from the unlatched position back to the latched position causing the actuator link to return from the second position back to the first position as the over-center biasing means biases the contact arm to hold the contacts open.

2. The circuit breaker mechanism in accordance with claim 1 wherein movement of said actuator link from the second position to first position when the cradle arm is held against the latch means in the latched position displaces the pivot of said contact arm over center relative to the connections on the cradle arm and the contact arm causing the over-center biasing means to displace said contact arm to open said contacts.

3. The circuit breaker mechanism in accordance with claim 1 comprising a switch mechanism moveably supported relative to the frame for moving said actuator link between said first and second positions.

4. The circuit breaker mechanism in accordance with claim 3 wherein said switch mechanism comprises a switch lever rotatably supported relative to the frame and coupled with said actuator link for moving said actuator link between its first and second positions.

5. The circuit breaker mechanism in accordance with claim 4 wherein said switch lever is rotatably connected with said actuator link and is movable between first and second stopped positions to pivot said actuator link respectively between its first and second positions.

6. The circuit breaker mechanism in accordance with claim 5 wherein said frame includes stops and said switch lever is supported so that the stops on the frame limit the movement of the switch lever and provide alternative stable rest positions for the switch lever.

7. The circuit breaker mechanism in accordance with claim 1 wherein the contact carried on the contact arm is displaceable relative to the frame and the other contact is held in relatively fixed position relative to the frame.

8. The circuit breaker mechanism in accordance with claim 1 comprising means rotatably connecting the actuator link with the contact arm to permit the actuator link and the contact arm to rotate relative to one another.

9. The circuit breaker mechanism in accordance with claim 1 wherein said activator link comprises a pair of spaced apart arms and said contact arm comprises a corresponding pair of spaced apart arms, each rotatably connected to a respective spaced apart arm of the actuator link.

10. The circuit breaker mechanism in accordance with claim 9 wherein said cradle arm is supported on the frame in position so that the cradle arm has a path of movement passing through the spaced apart arms of the actuator link and the contact arm.

11. The circuit breaker mechanism in accordance with claim 9 wherein each arm of one of the pairs of the spaced apart arms includes a channelled portion and wherein further each arm of the other pair of spaced apart arms includes a pin stub rotatably captured within a respective one of the channelled portions to permit rotational movement of the contact arm and the actuator link relative to one another.

12. The circuit breaker mechanism in accordance with claim 1 wherein said contact arm and said link have cooperating portions enabling rotational movement of the contact arm and the actuator link relative to one another.

13. The circuit breaker mechanism in accordance with claim 1 having stop means for limiting movement of the actuator link between its first and second positions.

14. The circuit breaker mechanism in accordance with claim 1 wherein said over-center biasing means comprises an extension spring connected between the cradle arm and the contact arm.

15. The circuit breaker mechanism in accordance with claim 1 wherein said frame provides a latch stop and said latch means comprises a latch displaceably mounted relative to the frame and latch biasing means connected between the frame and the latch for biasing said latch against the latch stop in a latching position so that said cradle arm is releasably latched in its latched position.

16. The circuit breaker mechanism in accordance with claim 15 wherein said trip means comprises a displaceable trip element engageable with said latch under said predetermined conditions to displace said latch against the bias of the latch biasing means to release the cradle arm from its latched position so that the cradle arm moves to its unlatched position.

17. The circuit breaker mechanism in accordance with claim 15 wherein said latch provides a cradle arm stop engageable by said cradle arm in the latched position, said latch biasing means holding said latch in the latching position so that the cradle arm engages the cradle arm stop to hold the cradle arm in the latched position and wherein further said trip means displaces said latch against the bias of the latch biasing means under said predetermined conditions causing said cradle arm stop to disengage from said cradle arm to permit displacement of the cradle arm under the bias of the over-center biasing means into its unlatched position.

18. The circuit breaker mechanism in accordance with claim 17 wherein said latch provides a cradle arm passageway proximate to said cradle arm stop, said cradle arm passageway being alignable with said cradle arm to permit movement of the cradle arm from the latched to the unlatched position, said latch biasing means holding said latch in its latching position in which the passageway is held out of alignment with the cradle arm and the cradle arm stop is positioned to engage and hold the cradle arm in the latched position and wherein further said trip means displaces said latch against the bias of the latch biasing means under said predetermined conditions to disengage said cradle arm stop from said cradle arm and to simultaneously align the passageway with the cradle arm to permit displacement of the cradle arm under the bias of the over-center biasing means through the aligned passageway into the unlatched position.

19. The circuit breaker mechanism in accordance with claim 18 wherein said latch comprises a shaft rotatably mounted relative to the frame to permit rotatable movement of said latch and wherein said passageway is provided by a transverse slot through the shaft and said cradle arm stop is provided by a portion of the outer peripheral surface of the shaft.

20. The circuit breaker mechanism in accordance with claim 19 wherein said latch has a rotational axis fixed in position relative to the frame.

21. The circuit breaker mechanism in accordance with claim 16 wherein said trip element, said latch, said cradle arm and said actuator link are each rotatably mounted relative to the frame and each have a respective rotational axis fixed in position relative to one another and relative to the frame.

22. The circuit breaker mechanism in accordance with claim 21 wherein the rotational axes of said trip element, said latch, said actuator link and said cradle arm are oriented generally parallel with one another.

23. The circuit breaker mechanism in accordance with claim 1 wherein said over-center biasing means biases said cradle arm into engagement with said latch means when the cradle arm is in the latched position and said cradle arm return means biases said cradle arm to reduce contact force between the cradle arm and the latch means.

24. The circuit breaker mechanism in accordance with claim 1 wherein said cradle arm is pivotally connected relative to the frame and displaceable about the pivotal connection.

25. The circuit breaker mechanism in accordance with claim 24 wherein said cradle arm is a generally C-shaped member having one end rotatably mounted to the frame and having an abutment end for engaging the latch means in the latched position and wherein further the connection of the over-center biasing means on the cradle arm is disposed intermediate the opposite ends of the cradle arm.

26. The circuit breaker mechanism in accordance with claim 24 wherein said actuator link comprises a pair of spaced apart arms and said contact arm comprises a pair of spaced apart arms each rotatably connected to a respective spaced apart arm of the actuator link to permit rotatable movement of the contact arm relative to the actuator link.

27. The circuit breaker mechanism in accordance with claim 26 wherein each of the spaced apart arms of the actuator link includes a pin stub and each of the spaced apart arms of the contact arm includes a channelled portion rotatably capturing a respective one of the pin stubs on the respective spaced apart arms of the actuator link.

28. The circuit breaker mechanism in accordance with claim 26 wherein said cradle arm is supported relative to the frame in position between the spaced apart arms of the contact arm and the actuator link and wherein said cradle arm moves from the latched position to the unlatched position along a path passing between the spaced apart arms of the contact arm and the actuator link.

29. The circuit breaker mechanism in accordance with claim 28 wherein said cradle arm is a generally C-shaped member having one end rotatably mounted to the frame and having an abutment end for engaging the latch means in the latched position and wherein further the connection of the over-center biasing means on the cradle arm is disposed intermediate the opposite ends of the cradle arm.

30. The circuit breaker mechanism in accordance with claim 28 wherein said cradle arm is rotatably mounted to the frame and said actuator link is rotatably mounted to the frame and the rotational axes of the cradle arm and the actuator link are generally parallel to one another and fixed in position relative to the frame.

31. The circuit breaker mechanism in accordance with claim 28 comprising a switch mechanism movably supported relative to the frame for moving said actuator link between its first and second positions.

32. The circuit breaker mechanism in accordance with claim 31 wherein said switch means comprises a manual switch lever rotatably supported relative to the frame, the switch lever having a first end providing a handle and a second end rotatably connected with the actuator link.

33. The circuit breaker mechanism in accordance with claim 32 wherein said switch lever and said actuator link are rotatably connected to one another and one includes a slotted portion and the other includes a pin rotatably captured within the slotted portion.

34. The circuit breaker mechanism in accordance with claim 33 wherein the actuator link includes a second pair of spaced apart arms and said pin is carried and supported between said second pair of spaced apart arms.

35. A circuit breaker mechanism comprising:

(A) a frame;

(B) a pair of contacts supported relative to the frame displaceable relative to one another between open and closed positions;

(C) a contact arm rotatably supported at a pin having an integral contact support carrying one of the contacts and being rotatable about said pin to open and close the contacts;

(D) a cradle arm rotatably mounted on the frame, said cradle arm being rotatable between a latched position and an unlatched position;

(E) an over-center extension spring connected between a connection on the contact arm and a connection on the cradle arm for biasing said contact arm into over-center positions about the contact arm pin;

(F) latch means having a displaceable latch and a latch spring supported relative to the frame, said latch spring biasing said latch into a latching position so that the latch releasably engages and latches said cradle arm in the latched position wherein the over-center spring holds the cradle arm against the latch;

(G) an actuator link rotatably mounted on the frame and pivotally coupled with the contact arm at the contact arm pin to provide the contact arm pivot so that when the cradle arm is held against the latch in the latched position movement of said actuator link from a first position to a second position displaces the pivot of the contact arm over center relative to the connections on the cradle arm and the contact arm causing the over-center biasing means to displace said contact arm to close the contacts;

(H) trip means supported relative to the frame for releasing the latch means under predetermined conditions, said trip means having a displaceable trip element for engaging and displacing said latch against the bias of the latch spring under said predetermined conditions to disengage said latch from said cradle arm to permit displacement of the cradle arm by the over-center spring from the latched position to the unlatched position causing the connection on the cradle arm to move relative to the pivot of the contact arm so that the pivot of the contact arm is passed over-center relative to the connections on the contact arm and the cradle arm causing the over-center spring to displace said contact arm to open the contacts; and (I) a cradle arm return spring connected between the frame and the cradle arm to displace the cradle arm from the unlatched position back to the latched position causing the actuator link to return from the second position back to the first position as the over-center spring biases the contact arm to hold the contacts open.

36. An arrangement of at least a first and second circuit breaker positioned side by side, each circuit breaker having a circuit breaker mechanism comprising:

(A) a frame;

(B) a pair of contacts supported relative to the frame displaceable relative to one another between open and closed positions;

(C) a contact arm supported relative to the frame carrying one of the contacts, said contact arm having a pivot and being displaceable to open and close the contacts;

(D) a cradle arm supported relative to the frame displaceable between a latched position and an unlatched position;

(E) over-center biasing means connected between a connection on the contact arm and a connection on the cradle arm for biasing said contact arm into over-center positions about the contact arm pivot;

(F) latch means supported relative to the frame for releasably latching said cradle arm in the latched position wherein the biasing means holds the cradle arm against the latch means;

(G) an actuator link pivotally mounted on the frame and coupled with the contact arm at the contact arm pivot so that when the cradle arm is held against the latch means in the latched position movement of said actuator link from a first position to a second position displaces the pivot of the contact arm over center relative to the connections on the cradle arm and the contact arm causing the over-center biasing means to displace said contact arm to close the contacts;

(H) trip means supported relative to the frame for releasing the latch means under predetermined conditions to permit displacement of the cradle arm by the biasing means from the latched position to the unlatched position moving the connection on the cradle arm relative to the pivot of the contact arm so that the contact arm pivot is passed over center relative to the connections on the contact arm and cradle arm causing the biasing means to displace said contact arm to open the contacts; and (I) cradle arm return means connected between the frame and the cradle arm to displace the cradle arm from the unlatched position back to the latched position causing the actuator link to return from the second position back to the first position as the over-center biasing means biases the contact arm to hold the contacts open;

the arrangement further comprising:

a rotatable shaft supported relative to the frames;

a displaceable crank arm mounted on the rotatable shaft proximate to the latch means of the first circuit breaker in a triggering position so that the movement of the cradle arm of the first breaker from the latched position to the unlatched position causes the cradle arm to engage the crank arm and rotate the shaft;

a displaceable trip arm mounted on the rotatable shaft proximate to the latch means of the second breaker so that the rotation of the shaft by the engagement of the cradle arm of the first breaker with the crank arm causes the trip arm to rotate from a first position to a second position releasing the latch means of the second breaker; and arm return means supported relative to the frame of one of the breakers for rotating the shaft to return the trip arm back to the first position and the crank arm back to its triggering position.

37. The circuit breaker mechanism in accordance with claim 1 wherein said cradle arm return means comprises return biasing means engaging said cradle arm to bias and displace said cradle arm from the unlatched position back to the latched position.

38. The circuit breaker mechanism in accordance with claim 37 wherein said return biasing means comprises a return spring.

39. The circuit breaker mechanism in accordance with claim 38 comprising a cradle arm pivot pin rotatably mounted relative to the frame and wherein said cradle arm is supported on the cradle arm pivot pin and wherein said return spring comprises a torsion spring carried on the cradle arm pivot pin having a portion engaging the cradle arm and another portion engaging the frame.

* * * * *

UNITED STATES PATENT AND TRADEMARK OFFICE

CERTIFICATE OF CORRECTION

PATENT NO. : 4,618,745

DATED : October 21, 1986

INVENTOR(S) : Harry A. Thompson, III

It is certified that error appears in the above-identified patent and that said Letters Patent is hereby corrected as shown below:

Column 5, line 7, "emobdiment" should be --embodiment--.

line 65, before "shaft" insert --cylindrical--.

Column 7, line 18, delete "a" (first occurrence).

Claim 9, Column 13, line 44, "activator" should be --actuator--.

Signed and Sealed this

Fourteenth Day of April, 1987

*Attest:*

*Attesting Officer*

DONALD J. QUIGG

*Commissioner of Patents and Trademarks*